United States Patent [19]

Daniello

[11] 4,185,673

[45] Jan. 29, 1980

[54] UNITARY ARTICLE-CARRYING BAG AND CUSHION

[76] Inventor: Margaret M. Daniello, 3 Deerfield Dr., West Orange, N.J. 07052

[21] Appl. No.: 885,487

[22] Filed: Mar. 13, 1978

[51] Int. Cl.[2] ..... A45C 3/06

[52] U.S. Cl. ..... 150/33; 5/442; 190/42

[58] Field of Search ..... 150/28 R, 33, 2.2; 190/2, 8, 42; 5/337, 339, 341, 434, 442; 220/449

[56] References Cited

U.S. PATENT DOCUMENTS

| | | | |
|---|---|---|---|
| 2,212,618 | 8/1940 | Rifkin | 220/449 |
| 2,293,530 | 8/1942 | Beehler | 190/42 |
| 2,962,731 | 12/1960 | Bounds | 5/337 |
| 3,148,389 | 9/1964 | Lustig | 5/341 X |
| 3,550,663 | 12/1970 | Johnston | 150/33 X |
| 3,669,169 | 6/1972 | Lubliner | 150/33 |
| 3,763,972 | 10/1973 | Karzmar | 190/8 |
| 3,938,569 | 2/1976 | Hill | 150/33 |

*Primary Examiner*—Donald F. Norton
*Attorney, Agent, or Firm*—Ronald G. Goebel

[57] ABSTRACT

A unitary article-carrying bag and cushion is provided comprising;

(a) an outer bag; and (b) a cushion material disposed along the inside surface of said outer bag to form a cavity for carrying articles.

The article-carrying bag preferably includes a lining overlying said cushion material and is also preferably equipped with carrying handles.

1 Claim, 4 Drawing Figures

UNITARY ARTICLE-CARRYING BAG AND CUSHION

BACKGROUND OF THE INVENTION

This invention is concerned with an article-carrying bag which also doubles as a cushion when the bag is emptied of articles.

The present invention has as its principal object, the provision of a device which serves the dual purpose of being both an article-carrying bag and a seat cushion when the articles are removed from the bag. The bag of this invention is particularly useful in recreational activities such as group games, picnicking and bathing whereby the user can carry game paraphernalia or picnic items in the bag, remove the articles therefrom at the game, picnic or bathing site and then use the bag as a cushion for a chair or stool provided at the game or for a comfortable seat on the ground or beach.

In the past, certain portable and foldable blankets and seats have been described in the art. In U.S Pat. No. 3,041,638 to S. A. Lovico, for example, a folded utility bag is provided having a removable lining, preferably of absorbent cloth, adapted to be used as a blanket by a person reclining on the spread-out bag. The utility bag contains a lining of absorbent fabric housed within an envelope characterized by being made up of four distinct, substantially coextensive principal portions. An array of slide fasteners on the lateral edges of the inner envelope between one end portion and an inner portion and on the remaining inner portion allow removal of a unit from the inner portions including the lining.

In U.S. Pat. No. 2,870,464 to M. J. Labick, a foldable blanket is provided having snap fasteners and a handle to enable closing of the blanket into a package-like condition and carrying the so-folded blanket from place to place. The blanket consists of a wool, fabric, plastic or other water-proof sheet which also contains fastening handles and strap. The blanket is half-folded along fold lines, quarterfolded and then cross-folded to provide a seat or package condition.

Article-carrying, foldable and portable bags which also double as a mattress or blanket in the unfolded condition have also been described in the art.

In U.S. Pat. No. 2,788,583 to H. Bornstein for example, a mattress is provided having a thickened end adapted to be doubled over and having fastening means whereby parts thereof can be releasably fastened together to form a bag-like containing portion which can be carried with the mouth of the containing portion facing upwardly by means of carrying handles. The fastening means include sliding clasp fasteners on longitudinal edges of the mattress such that the first third part of the mattress can be folded over the second third part so that the mattress becomes doubled over with the thicker end hanging downwardly. By connecting the fasteners, the blanket is converted to a bag which can be used to carry small articles. Similarly, other patents have described blankets convertible to a bag by means of folding and applying fastening means to the free edges thereof; see for example U.S. Pat. No. 2,315,126 to F. Michalke (blanket convertible to a bag); and U.S. Pat. No. 3,489,194 to D. H. Hoover (diapering station convertible to a bag).

The present invention, unlike the above patents, is concerned with a unitary article-carrying bag and cushion. It does not employ slidable fasteners or any manipulation of the bag itself to form a cushion because the cushion and bag features are simultaneously contained within the construction of the bag itself; that is, it does not require formation of a bag from a cushion or vice versa as in the above patents. It is at once both a bag and a cushion. By virtue of the elimination of fasteners which are often unreliable and involve time and inconvenience in their use, the present invention provides a more reliable and convenient bag convertible to a seat cushion then similar bags described heretofore.

SUMMARY OF THE INVENTION

The present invention provides a unitary article-carrying bag and cushion which comprises an outer bag made of cloth or other similar material and having located within the bag a cushion material disposed along the inside surface of the bag. Articles can be carried within the inner cavity defined by the cushion material and when removed, the bag is placed on a chair, stool or the ground and used directly as a cushion. The bag of this invention preferably contains a bag-like lining made of a sheet material connected to the upper edge of said outer bag and overlying said cushion material.

The cushion material may also consist of two layers of cushion material, each layer disposed along opposing inside surfaces of said outer bag. In such case the lining consists of two layers of sheet material overlying the cushion material which are fastened to the bottom of the outer bag to retain the cushion material against the side of the outer bag.

The bag is also equipped with carrying handles, preferably made of cloth which can be tucked inside the article-carrying bag before sitting or reclining thereon.

The cushion material may be comprised of any well-known material such as foam or sponge rubber or even a feathery or fibrous material.

DETAILED DESCRIPTION OF THE PREFERRED EMBODIMENTS

Figure 1:
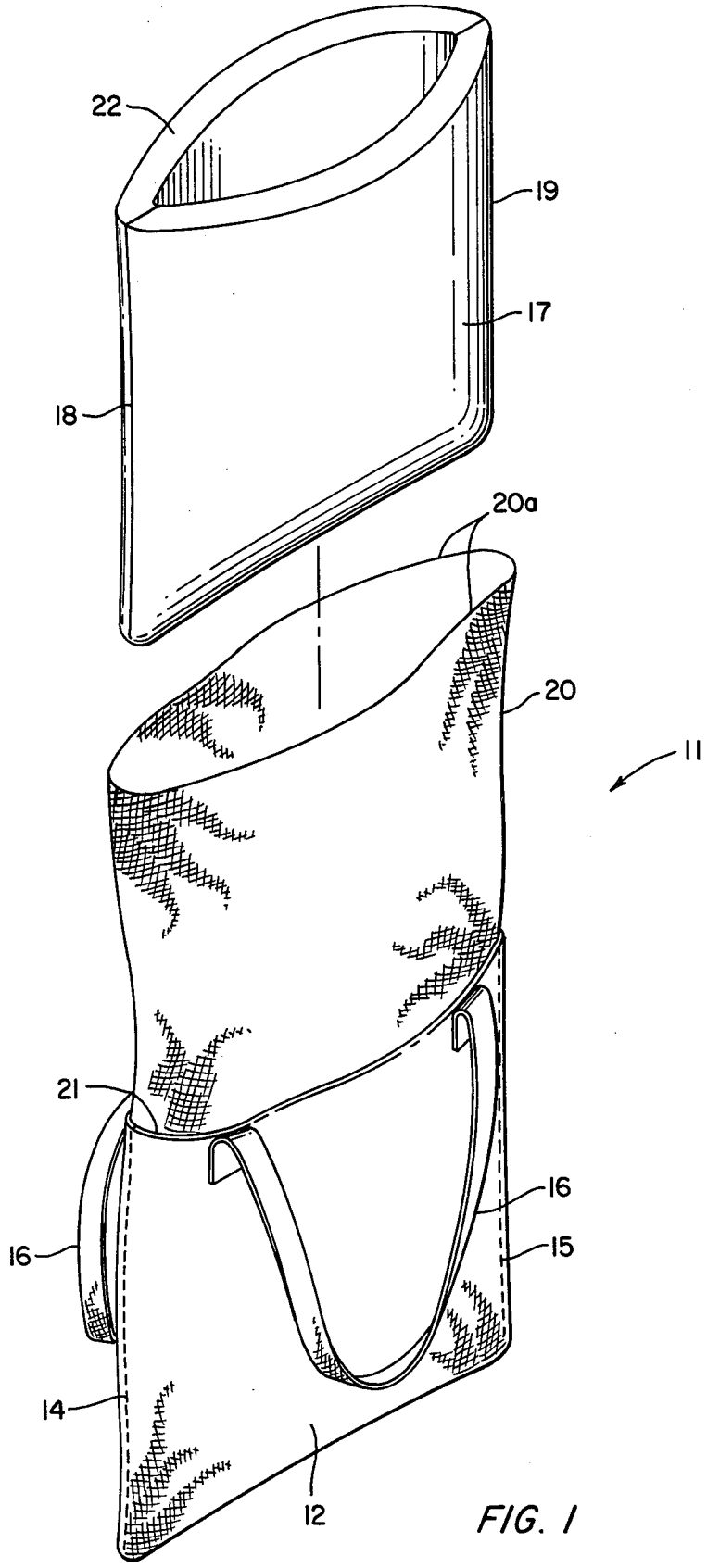
FIG. 1 is an exploded view of the preferred article-carrying bag of this invention showing the assembly of outer bag, cushioning material and insert.

FIG. 1 shows an exploded view of the cushioned article-carrying bag of this invention which is indicated generally by 11. The bag 11 consists of an outer bag member 12 made of cloth or similar material which is used for carrying or storing articles. The outer bag member may be formed by simply folding a rectangular piece of cloth in half and stitching the sides together as at 14 and 15. A pair of handles or straps 16 also made of cloth material are sewn to the top edge 21 of the bag to enable it to be carried by hand, over the shoulder or around the arms.

Disposed within the bag 12 along the inside surface thereof is an inner cushion insert 17 which is shown above the bag 12 in FIG. 1. The cushion insert 17 is comprised of a material such as foam or sponge rubber or any other material capable of maintaining its shape and integrity after sitting or reclining thereon. The shape of the cushion is substantially the same as the outer bag 12 but is sufficiently smaller to fit within the outer bag along its inside surface. As in the case of the outer bag 12, the cushion insert 17 may be formed by folding a rectangular piece of cushioning material in half and connecting the edges at 18 and 19 by gluing, bonding or other suitable means. The thickness 22 of the insert 17 should be from about ½ to 1½ inches and preferably about three quarters of an inch.

It is also within the scope of this invention to employ an insert comprising a fibrous or feathery cushioning material such as down inside a casing having a shape and size similar to the unitary cushion insert 17 described above.

Figure 2:
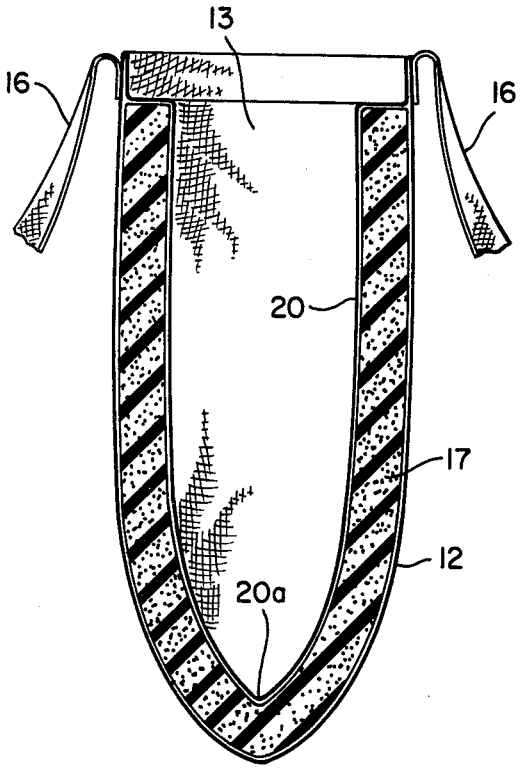
FIG. 2 is a cross-sectional view of the bag of FIG. 1 in the assembled condition.

The cushioned article-carrying bag of this invention preferably contains a cloth lining 20 which is connected along the upper edge 21 of the outer bag 12 by stitching, for example, and which extends into the bag to overlie the cushion insert 17. The cloth lining 20 protects the cushion insert 17 from being damaged by articles placed in the bag. FIG. 1 shows the cloth lining 20 turned inside out with its bottom edges 20*a* unconnected. The lining 20 is preferably comprised of a smooth sheet material and is in the shape of a bag, as shown in FIG. 1, when the edges 20*a* are sewn together and placed over the cushion insert 17 inside the bag. FIG. 2 is a sectional end view of the bag of this invention showing the position of the outer bag 12, cushion insert 17 and cloth lining 20 which defines a cavity 13 for carrying articles.

Figure 3:
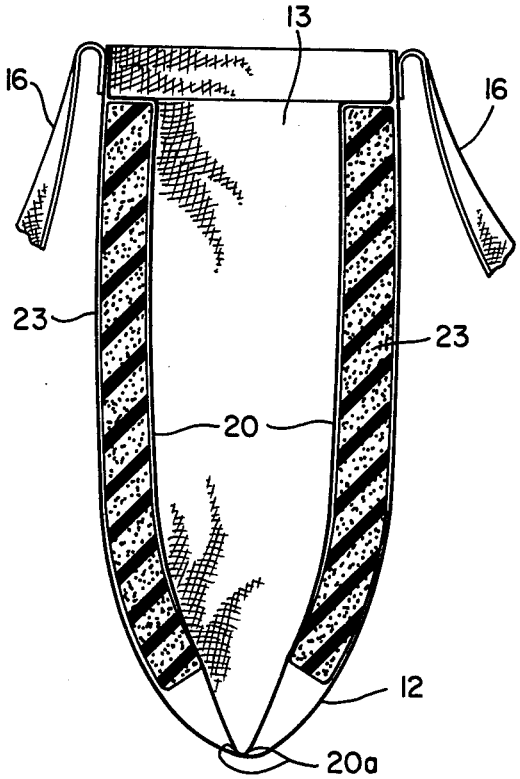
FIG. 3 is a cross-sectional view of an article-carrying bag having two layers of cushion material on opposing inside surfaces of the outer bag.

FIG. 3 shows a sectional view of another embodiment of the invention which employs a layer of cushioning material 23 on opposing inside surfaces of the bag 12 as a lining instead of a unitary cushion insert 17. Each layer of cushioning material 23 is held between the lining 20 and inside surface of the outer bag 12 by stitching the bottom edges 20*a* of the lining 20 to the bottom of the bag.

Figure 4:
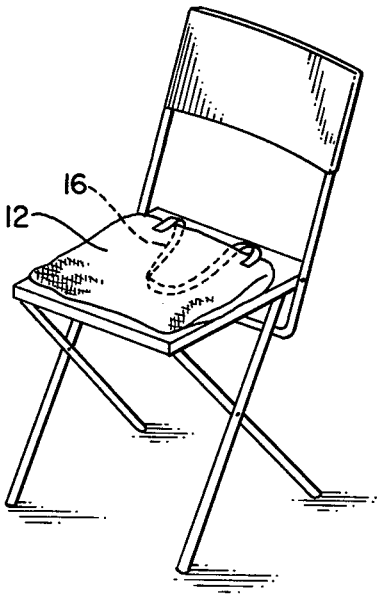
FIG. 4 shows the article-carrying bag of this invention as a cushion for a chair.

The unitary article-carrying bag and cushion of this invention as described above can be used to carry small articles such as beach items, toiletries, cosmetics, small packages, cigarettes, bottles, puzzles, games, etc. After the articles are removed, the carrying handles are tucked in the cavity 13 and the bag can then be placed on a chair or stool as shown in FIG. 4 to be used as a cushion therefor.

The article-carrying bag of this invention is particularly useful for group games such as Bingo where the sponsoring authority for the game does not provide comfortable seats for the players. By using the present invention, the player can carry his chips, cards, eyeglasses, pencils, and other game paraphernalia in the bag, remove the articles from the bag to set up his game and then place the empty bag on a stool or chair as a cushion therefor.

The bag is also useful for activities in which there are little or no seating arrangements provided such as bathing and picnicking. By using the present cushioned article-carrying bag, necessary items such as suntan oil, sunglasses, towels, swimsuits, sandals, eating utensils, snacks etc. can be carried in the bag to the beach and picnic area. Upon arrival the articles are removed from the bag and the empty bag is then used as a comfortable seat on the sand or grass.

The bag may also be used by children in nursery schools where they can use the bag as a pillow during rest periods and also carry small articles therein between home and school. The bag may also serve as a car cushion while driving as well as an article-carrying bag when leaving the car for shopping or other purposes. By making the lining waterproof, the bag also can be used as a boat cushion and a fishing gear carrier for those interested in fishing.

I claim:

1. A hand carryable unitary article-carrying bag and cushion comprising:

(a) an outer cloth bag defining a cavity;

(b) a cushioned insert in the form of a bag comprised of foam rubber or sponge rubber having a thickness of from ½ to 1½ inches fitted within said cavity along the inside surface of said outer bag and being unsecured to said outer bag;

(c) a lining attached to said outer bag and overlying said cushioned insert; and (d) a pair of carrying handles fastened to said outer bag.

* * * * *